US006565424B2

(12) United States Patent
Katagiri et al.

(10) Patent No.: US 6,565,424 B2
(45) Date of Patent: May 20, 2003

(54) METHOD AND APPARATUS FOR PLANARIZING SEMICONDUCTOR DEVICE

(75) Inventors: Souichi Katagiri, Kodaira (JP); Yoshio Kawamura, Kokubunji (JP); Kan Yasui, Kodaira (JP); Masayuki Nagasawa, Kawagoe (JP); Ui Yamaguchi, Urawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/863,264

(22) Filed: May 24, 2001

(65) Prior Publication Data

US 2002/0049026 A1 Apr. 25, 2002

(30) Foreign Application Priority Data

May 26, 2000 (JP) ..... 2000-161125

(51) Int. Cl.[7] ..... B24B 1/00
(52) U.S. Cl. ..... 451/285; 451/287; 451/398
(58) Field of Search ..... 451/8, 9, 10, 11, 451/41, 54, 63, 285, 287, 288, 289, 397, 398, 21

(56) References Cited

U.S. PATENT DOCUMENTS 6,019,670 A * 2/2000 Cheng et al. ..... 451/56
6,059,636 A 5/2000 Inaba et al.
6,077,151 A * 6/2000 Black et al. ..... 451/53
6,113,468 A * 9/2000 Natalicio ..... 451/41
6,180,020 B1 1/2001 Moriyama et al.
6,290,577 B1 * 9/2001 Shendon et al. ..... 451/41

FOREIGN PATENT DOCUMENTS

| | | |
|---|---|---|
| JP | 9-57612 | 3/1997 |
| JP | 11-198025 | 7/1999 |
| JP | 11-221756 | 8/1999 |
| JP | 11-235662 | 8/1999 |
| JP | 2000-190203 | 7/2000 |
| WO | WO9710613 | 3/1997 |

* cited by examiner

*Primary Examiner*—Eileen P. Morgan
(74) *Attorney, Agent, or Firm*—Mattingly, Stanger & Malur, P.C.

(57) ABSTRACT

The invention provides a process apparatus including a wafer holder, and a process method, in which high planarization performance, scratch free process, narrow edge exclusion and high uniformity can be maintained for more than 10,000 processed wafers. The invention is achieved by providing a unit for keeping a retainer and surface of a polishing wheel non-contact with each other and controlling the gap within a certain range and by setting compression strength of the retainer at more than 3,000 kg/cm$^2$.

2 Claims, 4 Drawing Sheets

METHOD AND APPARATUS FOR PLANARIZING SEMICONDUCTOR DEVICE

BACKGROUND OF THE INVENTION

1. Field of the Invention

The present invention relates to planarization method and apparatus for patterns on a wafer surface with polishing used in manufacturing process for semiconductor integrated circuit. The present invention particularly relates to a wafer holder that provides high process uniformity and high reliability over an entire surface area including a wafer outer periphery.

2. Description of the Related Art

Recently, importance of planarization of wafer surface with semiconductor devices formed thereon have been increasing because of a problem on insufficient focusing margin for exposure optical system in lithography process due to increasing density and reducing size of semiconductor device. One of the wafer planarization techniques is a polishing technique so-called "Chemical Mechanical Polishing (CMP)" shown in FIG. 3.

A polishing pad 16 is attached on a rotation platen 15 and rotated. The polishing pad 16 is, for example, made by slicing polyurethane foam resin into form of thin sheet and molding it. Different materials form of thin sheet and molding it. Different materials and surface fine structures for the polishing pad 16 are selected depending on the type of workpiece and desired roughness of the surface to be finished. On the other hand, as described in Japanese Patent Laid-Open Publication No. 11-198025, a retainer 18 is provided for a wafer 2 to be processed, which is intended to prevent the wafer from projecting by horizontal force due to friction between the wafer and the polishing pad, and the wafer is pressed against the polishing pad 16 with constant pressure. Projections of insulator film on the wafer surface are polished and removed for substantial planarization, by pressing the backside of the wafer 2 with flexible means such as air or sponge with rotation of a wafer holder 17 to press the wafer against the polishing pad 16, and supplying a polishing slurry 14 on the polishing pad 16.

When insulator film like silicon dioxide is polished, colloidal silica is typically used as polishing slurry. The colloidal silica is prepared by suspending fine silica particle about 30 nm diameter in alkali aqueous solution such as aqueous potassium hydroxide. It is characterized in that it provides much higher process efficiency and smooth surface with less process damage as compared with mechanical polishing with only abrasive grain since it additionally has alkali chemical reaction effect.

As described above, the method in which workpiece is processed while polishing slurry is supplied between a polishing pad and the workpiece, is well known as "loose abrasive grain polishing technique". However, it has a problem for pattern size dependency that adequate planarization may be not provided depending on the pattern type and height profile condition, a problem of extremely high cost for consumable supplies such as polishing slurry and polishing pads, and subject issue like inadequate long-term stability due to polishing pad consumption.

A planarization concept with bounded abrasive grain polishing is disclosed in PCT/JP95/01814 for eliminating such disadvantage of planalization with loose abrasive grain polishing.

The new planalization technique is characterized in that in the polishing apparatus shown in FIG. 3 it uses a special polishing wheel 1 that is hardness-controlled in best optimization, instead of conventional polishing pads. Specifically, the modulus of elasticity of the polishing wheel 1 is 5 to 500 kg/mm$^2$, one tenth to one hundredth of the modulus of elasticity of conventional typical polishing wheel while it is five to fifty times as hard polishing pad such as pads of hard polyurethane foam.

The type of the slurry is preferably such as silicon dioxide, cerium oxide, or aluminum oxide. The slurry with 0.01 to 1 $\mu$m in grain diameter provides good process efficiency without scratch occurrence. The resin for binding these abrasive grains is preferably high purity organic based resin such as phenol based resin or polyethylene based resin. The abrasive grain is kneaded in binding resin, then the resin is solidified in adequate pressure and, if necessary, is subject to treatment such as thermal curing. In the preparation method, the hardness of polishing wheel to be formed can be controlled by the type of binding resin and the pressing pressure, and is set at 5 to 500 kg/mm$^2$ in this technique.

When pure water is supplied as polishing solution to a polishing wheel that is formed by binding cerium oxide abrasive grain with 1 $\mu$m in grain size with phenol based resin or polyethylene based resin such that the modulus of elasticity of the polishing wheel is 100 kg/mm$^2$, then silicon dioxide film with 1 $\mu$m in thickness is processed with the solution, very good planarization performance is provided such that no scratch occurs and processing rate is within 0.3±0.011 $\mu$m/minute for all type of patterns raging from 10 mm to 0.5 $\mu$m in pattern width. It is verified by the inventor that the scratch free process could not be compatible with the good planarization performance without the bounded abrasive grain process utilizing the polishing wheel with optimized modulus of elasticity.

As described above, planarization techniques that use a polishing wheel as a polishing tool have many advantages. On the other hand, they have a disadvantage for process uniformity because of much higher modulus elasticity of the polishing wheel than polishing pads.

At the time of performing loose abrasive grain polishing with a polishing pad, it is done with the retainer 18 being pressed against the polishing pad, as described above with reference to FIG. 3. It causes the retainer 18 to be worn with the wafer polishing. Balancing between pressing pressure applied to the wafer backside during polishing and receiving pressure at the wafer front-side is made with help of elastic deformation of the flexible polishing pad. However, when the retainer 18 is worn, it needs to be replaced since the pressure distribution over a wafer surface is no longer uniform. In the case of bounded abrasive grain polishing utilizing a polishing wheel with high modulus of elasticity, it is more difficult to continuously provide good uniformity than CMP since there is almost no deformation effect of the polishing wheel itself.

In the case of bounded abrasive grain polishing using a polishing wheel with high modulus of elasticity, there is a problem that since friction occurring during process is one time and half to two times higher than friction in loose abrasive grain polishing using a polishing pad the periphery of wafer 2 tends to be over-polished because of processed wafer 2 being pressed against the retainer 18, making it difficult to narrow edge exclusion that is exclusion area at the wafer periphery.

As described above, bounded abrasive grain polishing using a polishing wheel has a disadvantage that uniformity is inadequate because of inadequate deformation absorbing capability of the polishing wheel in conventional wafer holders, a disadvantage that edge exclusion cannot be narrowed, and so on.

SUMMARY OF THE INVENTION

An object of the present invention is to provide a process apparatus including a wafer holder, and a process method, in which high planarization performance, scratch free process, narrow edge exclusion and high uniformity can be maintained for more than 10,000 processed wafers.

The object can be achieved by providing means for keeping a retainer ring and surface of a polishing wheel non-contact with each other and controlling the gap therebetween within a certain range and by setting compression strength of the retainer ring at more than 3,000 kg/cm$^2$.

DESCRIPTION OF THE PREFERRED EMBODIMENT

Figure 1:
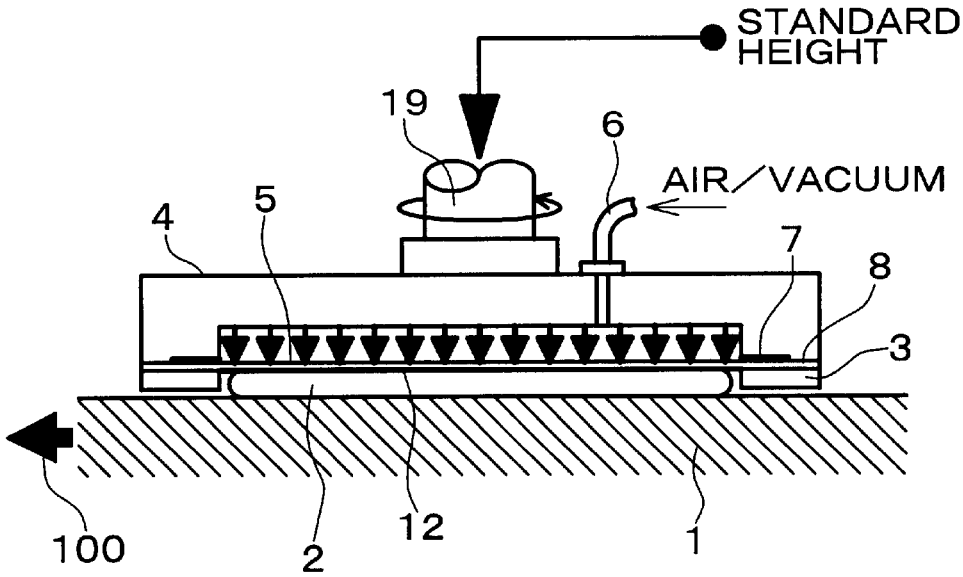
FIG. 1 is a schematic view describing the present invention.

An embodiment of the present invention will be described with reference to FIG. 1 that is a schematic cross section view of a main part.

An air tube 6 for air intake/exhaust to control air pressure within a holder 4 is provided in the holder 4. A sheet 5 flexibly expanding/contracting depending on the air pressure is attached on periphery of the air chamber at the side for sticking a wafer 2. Typically, it is used with a sponge layer 12 with about 0.5 mm in thickness being attached with double side tape or the like onto the wafer sticking side of the sheet 5 to increase adhesion between the sheet 5 and the wafer 2. Organic material such as polyethylene terephthalate (PET) or polyimide (PI) is suitable for the sheet material in view of elastic strength and strength against repeated loading.

A mechanism for planarization with a holder according to the present invention will be described hereafter. After the wafer 2 is stuck to wafer transfer means (not shown), the holder 4 moves, then halts above a polishing wheel 1. The polishing wheel 1 rotates in direction of an arrow 100 at this point. The holder 4 starts rotation and moves down toward the polishing wheel. The moving down distance is controlled by control means (not shown). The holder 4 stops at a level where a side of the wafer 2 to be processed contacts with the polishing wheel 1 and desired air pressure is applied onto the backside of the wafer 2 and the retainer 3 does not contact with the polishing wheel 1. The processing of wafer with the retainer ring 3 being non-contact with the polishing wheel 1 thus provides an advantage that replacement work for the retainer ring 3 due to wear of the conventional retainer ring 3 and the polishing wheel 1 is eliminated, and a great effect that the equipment availability is increased.

The second problem for improving durability is warp of the sheet 5. Two main causes of the second problem are expansion of the sheet due to wetting during polishing, and shift of contact area in the air chamber periphery. In the present invention, the sheet is pre-wetted to be fully expanded, then attached to the holder 4. This procedure allows preparation under condition close to actual process condition, thus avoiding the sheet warping due to the sheet wetting.

A double-side tape is typically used to attach the sheet 5 to the holder 4. The reason is that since the attachment needs to be resistant against friction occurring during the wafer processing the double-side tape is suitable because of its thrust resistance and high viscoelasticity. However, since adhesion layer of the double side tape is gel with about 5 $\mu$m in thickness, it tends to be elasto-plastically deformed for lateral thrust and cannot create restoration force because of the configuration in which the tape is attached on the most outer periphery of the holder, resulting in irreversible shear deformation. Therefore, attachment of the sheet to the holder only with the double-side tape causes problem that the sheet 5 is warped during wafer processing and reproduction accuracy for the wafer processing force is lowered. Thus, the present invention employs a configuration wherein, as shown in FIG. 1, viscoelastic double-side tape 7 on inner area and an adhesion layer 8 with adhesive resistant to shear deformation on outer area are both used. A type of adhesive that has high deformation resistance against thrust, such as instant adhesive, for example, ARON ALPHA produced by TOAGOSEI Co., Ltd., may be selected as effective adhesive. The configuration allows prevention of the sheet 5 from warping due to thrust during wafer processing, thus achieving much higher durability and longer life of the sheet 5.

As described so far, planarization with a polishing wheel with high modulus elasticity, wherein the retainer ring 3 is kept in non-contact with the polishing wheel 1 substantially in parallel state by controlling the holder level and the adhesion configuration for the sheet 5 includes both the double-side tape 7 and the adhesion layer 8, allows good uniformity that lasts long time.

On the other hand, solutions according to the present invention for three other technical problems occurring on actual processing will be described. A first technical problem is a phenomenon that the holder 4 leans forward due to friction during the wafer processing, which lowers uniformity since the load is mainly applied to the wafer periphery area to produce over-polishing therein. For this problem, substantial increase of rigidness of a rotation shaft 19 and the holder 4 in FIG. 1 is the solution. It means that the problem is solved by increasing the rigidness of the parts such that inclination of the holder due to friction is negligible.

A second technical problem is regarding preciseness for continuously keeping constant gap between the retainer ring 3 and the polishing wheel 1. Variation of the gap causes lower uniformity since the load applied to the wafer periphery is larger at narrower-gap region and lower at wider-gap region. This phenomenon is, in particular, a specific problem in process using a hard polishing wheel with high planarization capability, which have not been found in conventional polishing techniques utilizing a polishing pad. Thus, it is needed to maintain the gap between the retainer ring 3 and the polishing wheel 1 within a certain tolerance over the entire periphery of the retainer. An experiment by the inventors shows a result that tolerance to keep uniformity within ±10% is within 30 to 50 μm.

Figure 2:
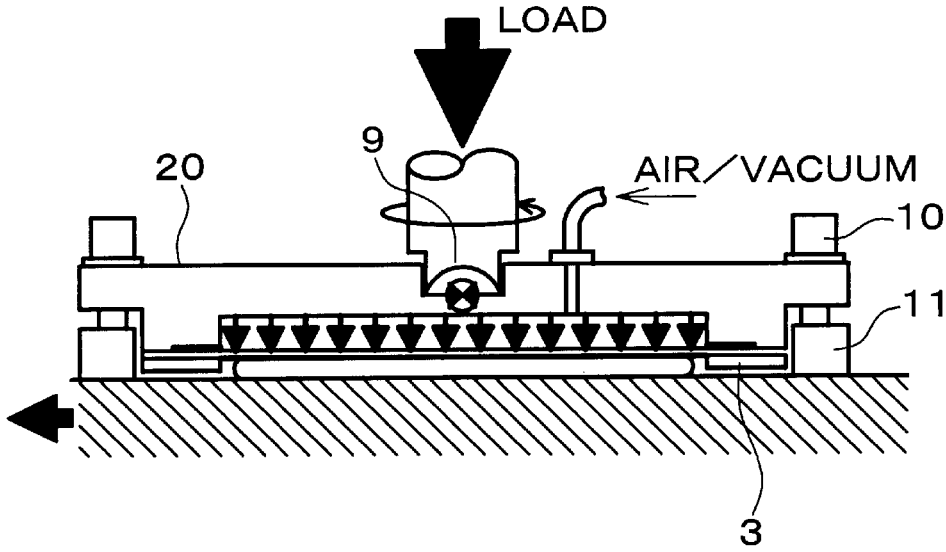
FIG. 2 is a schematic view describing a dual retainer holder.
Figure 3:
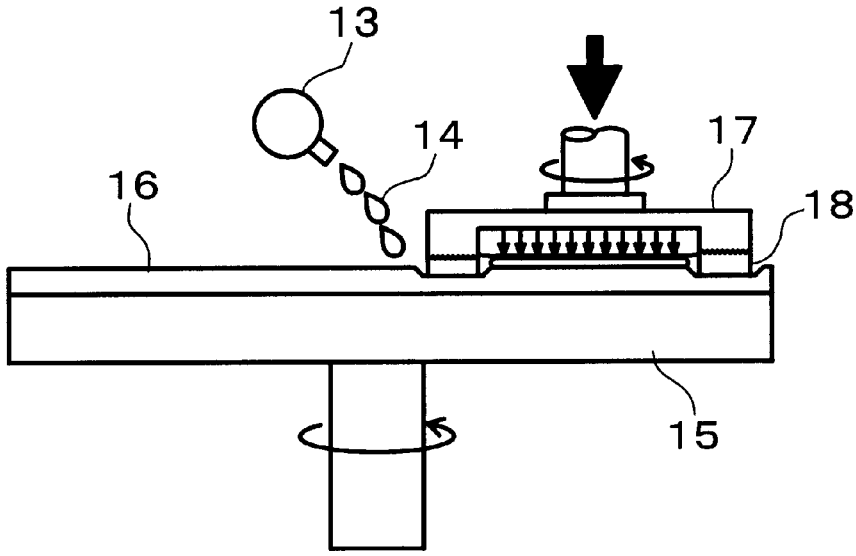
FIG. 3 is a schematic view describing a conventional planarization polishing technique for a semiconductor.

In the case of planarization with a polishing wheel, the surface of the polishing wheel needs to be subject to dressing to refresh glazing produced with wafer processing. Thus thickness of the polishing wheel decreases with wafer processing. Therefore, there is need for control means for updating target of holder height level during wafer processing to make it follow height level suitable for the current thickness of polishing wheel. In order to solve this technical problem, a polishing wheel surface level sensor may be provided to measure surface level of the polishing wheel and control may be performed such that lower side level of the retainer ring keeps a predetermined gap with respect to the surface level. Additionally, a holder with a dual retainer configuration (dual retainer holder) as shown in FIG. 2 may be also used.

The dual retainer has a configuration wherein an outer retainer ring 11 is provided outside a conventional retainer ring 3, and the outer retainer ring 11 is configured to vary projection length of the retainer 11 by send-out mechanism 10. A certain error in perpendicular state between the holder rotation shaft and the surface of the polishing wheel 1 is tolerated since the connection between the rotation and the holder is via a gimbal mechanism 9. Therefore, such configuration eliminates needs for holder level control means described with reference to FIG. 1, the holder and rotation shaft which are stiffened, and means for implementing mechanism to adjust the parallel state between the polishing wheel surface and the retainer, resulting in easily improved reliability.

Figure 4:
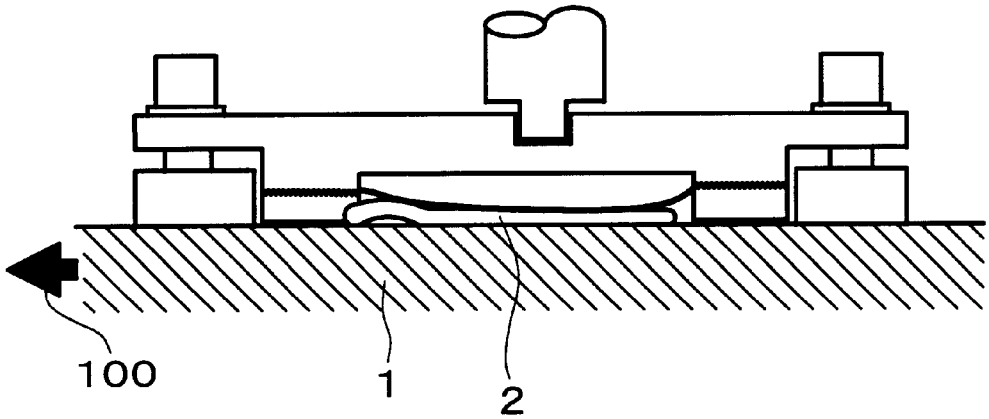
FIG. 4 is a schematic view describing a reason of lower uniformity.
Figure 8:
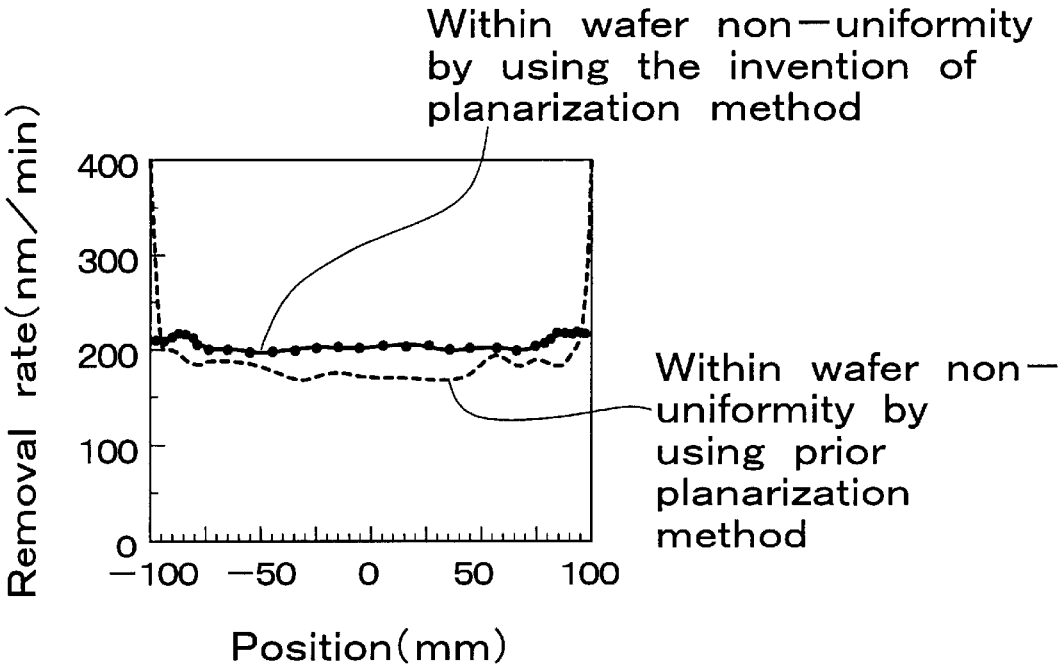
FIG. 8 is a schematic view describing process uniformity for wafer to which the present invention is applied.

A third technical problem is regarding over-polishing in wafer edge region due to elasto-plastic deformation of the retainer ring 3. This phenomenon will be described with reference to FIG. 4. The wafer 2 is pressed against the polishing wheel 1 and relatively rubbed with the wheel, so that it is subject to force that exerts on the wafer to move it out of the holder because of friction in direction of the arrow 100. The force is received on the retainer ring 3. Material used for the retainer ring 3 is often resin in view of prevention of contamination. Typically used as the material are engineering plastics with low wear such as polyoxymethylene (POM), poly phenylene sulfide (PPS), poly ether ether ketone (PEEK), or nylon. Compression strength of such materials is not more than about 1,000 kg/cm$^2$, one fifth to one tenth of compression strength of metal material. Concentrated load of about 1,000 to 3,000 kg/cm$^2$ is applied to the retainer ring 3 through contact portion of the wafer edge to plastically deform the retainer ring 3. It was founded by the inventors that this plastic deformation increases load at the wafer periphery since the wafer edge is pressed against the polishing wheel 1 in part, as shown, resulting in over-polishing at the periphery. This problem was solved by using material with high compression strength resistant to compression force from the wafer, as material for retainer ring. Stainless steel, for example, has an adequate characteristic because of its compression strength of more than 5,000 kg/cm$^2$. When processed with the stainless steel retainer ring, good uniformity was provided, that is within ±6%, as shown in FIG. 8. When the retainer ring is mounted on a holder in which conventional polishing wheel surface and retainer surface are contact-pressed, surface glazing of the polishing wheel occurs because of hardness of the retainer surface. It means a problem occurs that abrasive grain effective for the process is coated with resin contained in the polishing wheel, resulting in lower rate. Phenomenon of glazing of the polishing wheel surface could not be prevented without the technique of the present invention for keeping the retainer ring and polishing wheel non-contact with each other. However, when metal material is used, there is a problem for possible contamination due to metal ion sticking to the wafer. In order to avoid the problem, material may be coated, which have no contamination problem for devices. For example, the coating material may be engineering plastic such as PEEK, or metal material such as Ti, TiN, Ta, or TaN. Of course, the coating thickness of PEEK should be set such that wafer edge deformation does not occur during the wafer processing, or elasto-plastic deformation is negligible, and is preferably 10 to 100 μm substantially. Polyimide (PI), polyamide imide (PAI), or Teflon may be also used instead of PEEK.

Figure 5:
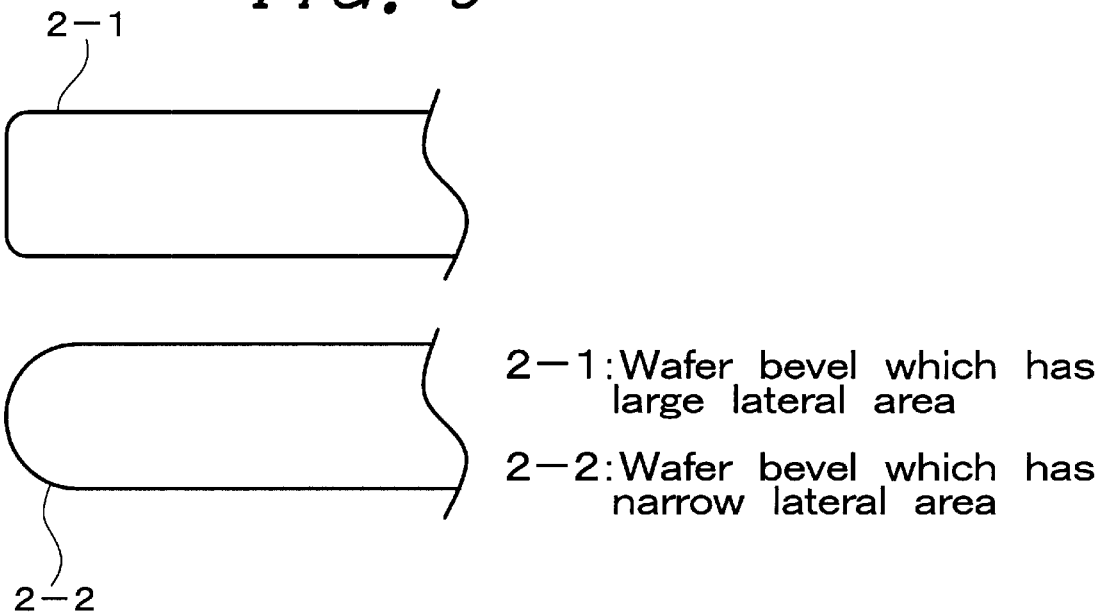
FIG. 5 is a schematic view describing shapes of wafer substrates.

Additionally, the problem of over-polishing due to the pressed wafer edge can be reduced by making a wafer shape specification such that bevel shape, the periphery edge profile of the wafer, is close to cylindrical profile as shown in FIG. 5, to increase the pressure reception area, since the problem depends on the force applied to the retainer surface by the wafer.

Figure 6:
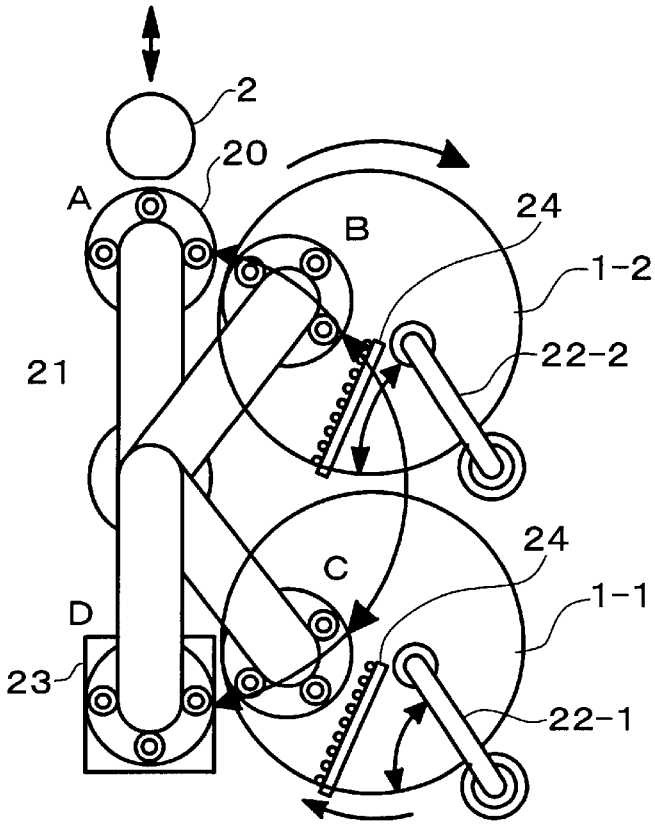
FIG. 6 is a schematic view describing an arrangement of a polishing apparatus using the present invention.

A specific example for arrangement of a process apparatus suitable to implement the present invention will be described with reference to FIG. 6.

This is an example for an arrangement that has two platens and one arm as essential parts. In the drawing, positions for a swing arm 21 depending on motions described below are shown at four sites A, B, C and D. A dual retainer holder 20 according to the present invention is mounted on the swing arm 21. The swing arm 21 is configured to perform rotational movement and can be rotationally located at positions, from a position above each platen to a position for retainer adjustment means. As there are two platens, a polishing wheel 1—1 with modulus of elasticity of 100 kg/mm$^2$ is mounted on the platen shown at lower part in the drawing, which provides adequate planarization performance, and a polishing wheel 1-2 with modulus of elasticity of 20 kg/mm$^2$ is mounted on the platen shown at upper part in the drawing, which has lower modulus of elasticity than the one of the polishing wheel 1—1. The latter is mounted for finishing process to remove a little scratch that occurs on the polishing wheel 1—1, and may be omitted if unnecessary. Additionally, the example is not limited to use of polishing wheel, but it is expected that use of conventional polishing pad may provides similar effect. A dresser (constant depth dresser) 22 that is able to cut into the polishing wheel by constant depth is embedded in each platen. A process solution supply nozzle 24 is provided above each polishing wheel.

Processing procedure will be described. A wafer 2 is chucked on the dual retainer holder 20 at swing arm position A by vacuum attraction and moved to position C, then halts. During this, the polishing wheel 1—1 rotates at predetermined revolution speed, and a constant depth dresser 22-1 dresses the polishing wheel 1—1 by cut-into depth of 1 μm. It is then started to supply process solution by the process solution supply nozzle 24. In the status, the dual retainer holder that have halted rotates at predetermined rotation while moving down, and the outer retainer 11 outside the dual retainer holder 20 contacts with the polishing wheel 1—1, then pressing it at predetermined load. At this point, the vacuum states in the dual retainer holder 20 is broken, and the wafer surface is processed by pressing the backside of the wafer 2 with pressurizing at predetermined air pressure. After processed for predetermined time, the pressure is released, and the wafer 2 is stuck on the dual retainer holder 20 by vacuum attraction. The holder 20 is then lifted from the polishing wheel 1—1 and moved to position B. The wafer 2 is processed on the polishing wheel 1-2 with same procedure as performed in the polishing wheel 1—1, and finally returned to the position A to be unloaded. A series of motions for the wafer processing have been described.

Figure 7:
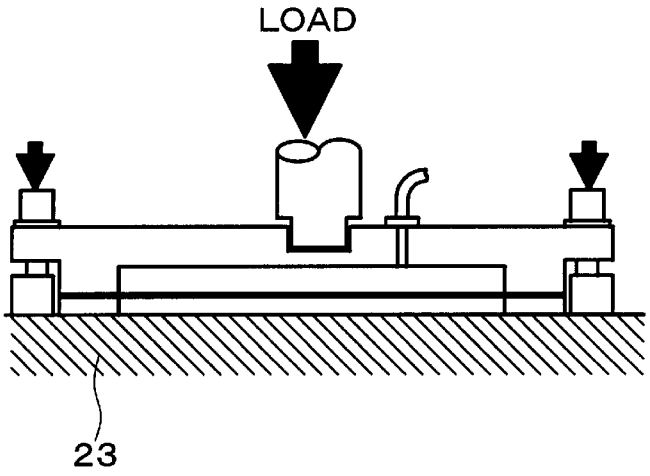
FIG. 7 is a schematic view describing means for adjusting retainer level difference of the dual retainer.

As the number of processed wafers increases up to predetermined number, for example, about 150 to 200, wear of the outer retainer 11 increases, resulting in lower uniformity. At this point, the swing arm 21 is moved to position D, and the retainer 11 is automatically adjusted. This adjustment is a job to adjust level difference between the outer retainer and the inner retainer to predetermined value, and it is desired that means for the adjustment is means for pressing the retainers onto a reference table 23 as shown in FIG. 7, since it can be implemented in a simple arrangement. In this adjustment means, the inner retainer is pressed onto the reference surface, and the outer retainer is then pushed down onto the reference table surface, and the retainers are then fixed. Timing of the adjustment may be for any of accumulated number of processed wafers, accumulated processing time, and any point due to uniformity monitoring.

Use of such arrangement and process procedure provides performance that has not been ever found, that maintenance-free processing is available for 10,000 to 20,000 wafers (the life for the polishing wheel) while high planarization performance with good uniformity is maintained.

Industrial applicability: The present invention is applicable to planarization and smoothing of substrate surface at extremely high precision such as planarization of semiconductor device wafer, and manufacturing of device with fine surface feature including liquid crystal display device, micro-machine, magnetic disk substrate, optical disk substrate, and Fresnel lens.

The present invention has an advantage that it achieves in long-life and highly reliable production level the planarization and smoothing of a substrate surface at extremely high precision such as planarization of the semiconductor device wafer, and manufacturing of the device with fine surface feature including a liquid crystal display device, a micro-machine, a magnetic disk substrate, an optical disk substrate, and a Fresnel lens.

What is claimed is:

1. A semiconductor substrate planarization apparatus for planarization-polishing patterns while a surface of a semiconductor substrate with the patterns formed thereon being pressed onto a surface of a fixed abrasive polishing tool and relative motion occurs therebetween, comprising:

means for applying fluid pressure onto a backside of the semiconductor substrate through a thin film sheet;

means for holding the semiconductor substrate with an inner retainer ring for prevention of the substrate from projection;

means for providing outside the inner retainer ring an outer retainer ring having a lower surface located below a lower surface of the inner retainer ring in order to keep constant the gap between the lower surface of the inner retainer ring and the surface of the fixed abrasive polishing tool; and wherein the apparatus comprises a convex mechanism for level difference correction in which a predetermined level difference is formed such that the level difference between the lower surface of the outer retainer and the lower surface of the inner retainer ring is predetermined distance, and the lower surface of the outer retainer and the lower surface of the inner retainer ring are parallel to each other.

2. A semiconductor substrate planarization apparatus for planarization-polishing patterns while a surface of a semiconductor substrate with the patterns formed thereon being pressed onto a surface of a fixed abrasive polishing tool and relative motion occurs therebetween, comprising:

means for applying fluid pressure onto a backside of the semiconductor substrate through a thin film sheet;

means for holding the semiconductor substrate with an inner retainer ring for prevention of the substrate from projection;

means for providing outside the inner retainer ring an outer retainer ring having a lower surface located below a lower surface of the inner retainer ring in order to keep constant the gap between the lower surface of the inner retainer ring and the surface of the fixed abrasive polishing tool;

wherein the apparatus comprises a convex mechanism for level difference correction in which a predetermined level difference is formed such that the level difference between the lower surface of the outer retainer and the lower surface of the inner retainer ring is predetermined distance, and the lower surface of the outer retainer and the lower surface of the inner retainer ring are parallel to each other; and wherein for change due to wear of the lower surface of the outer retainer, in level difference between the lower surface of the outer retainer and the lower surface of the inner retainer ring, and for change due to one-sided wear of the lower surface of the outer retainer, in parallel state between the lower surface of the outer retainer and the lower surface of the inner retainer ring, adjustment is performed such that level difference between the lower surface of the outer retainer and the lower surface of the inner retainer ring is predetermined distance and the lower surfaces of them are substantially parallel to each other by using the convex mechanism.

* * * * *